US007967666B1

(12) United States Patent
Messner

(10) Patent No.: US 7,967,666 B1
(45) Date of Patent: Jun. 28, 2011

(54) BLADE SHARPENER

(76) Inventor: Marvin Messner, St. Joseph, MO (US)

( * ) Notice: Subject to any disclaimer, the term of this patent is extended or adjusted under 35 U.S.C. 154(b) by 0 days.

(21) Appl. No.: 12/775,334

(22) Filed: May 6, 2010

(51) Int. Cl.
*B24B 23/00* (2006.01)

(52) U.S. Cl. ..... 451/349; 76/37; 76/82

(58) Field of Classification Search ..... 76/37, 41, 76/43.82

See application file for complete search history.

(56) References Cited

U.S. PATENT DOCUMENTS

| | | | | | |
|---|---|---|---|---|---|
| 1,494,995 | A | * | 5/1924 | Craddock | 76/38 |
| 2,434,691 | A | * | 1/1948 | Fields | 76/37 |
| 2,497,775 | A | * | 2/1950 | Jensen | 76/40 |
| 2,627,142 | A | * | 2/1953 | Pickel | 451/141 |
| 2,711,658 | A | * | 6/1955 | Hugghins | 76/79 |
| 2,921,484 | A | * | 1/1960 | Holst et al. | 76/40 |
| 3,139,774 | A | * | 7/1964 | Sipinen et al. | 76/40 |
| 3,204,491 | A | * | 9/1965 | Sagarian | 76/43 |
| 3,457,809 | A | * | 7/1969 | Bowerman | 76/40 |
| 3,481,224 | A | * | 12/1969 | Aijala | 76/40 |
| 3,585,879 | A | * | 6/1971 | Gunderman | 76/41 |
| 3,880,019 | A | * | 4/1975 | Young | 76/37 |
| 4,485,591 | A | * | 12/1984 | Bolin | 451/141 |
| 5,257,563 | A | * | 11/1993 | Hutchinson | 76/40 |
| 5,893,792 | A | * | 4/1999 | Scott | 451/45 |
| 7,114,413 | B1 | * | 10/2006 | Behan | 76/89 |
| RE39,492 | E | * | 2/2007 | Scott | 451/45 |
| 2007/0184756 | A1 | * | 8/2007 | Dieck et al. | 451/11 |

* cited by examiner

*Primary Examiner* — Maurina Rachuba
(74) *Attorney, Agent, or Firm* — Hovey Williams LLP

(57) ABSTRACT

An apparatus useful for sharpening blades includes a blade support, a sharpener guide mounted to the blade support, and a sharpener mount. The sharpener guide includes an elongated guide member defining a sharpening axis extending substantially parallel to a blade axis defined by the blade support. The sharpener mount includes a pivot connector coupled to and complementally configured with the elongated guide member for enabling pivotal movement of the sharpener mount about the sharpening axis and translational movement along the elongated guide member. The sharpener mount may be coupled to a rotary grinder having a grinding wheel, such that the sharpener mount and the grinder may pivot to provide a desired sharpening angle on the blade and move the grinder along the blade while the blade remains in place on the blade support.

12 Claims, 5 Drawing Sheets

BLADE SHARPENER

BACKGROUND OF THE INVENTION

1. Field of the Invention

The present invention broadly concerns a blade sharpener useful for sharpening the blades of cutting implements, for example, lawn mower blades. More particularly, it is concerned with a blade sharpener which serves as a support for a blade and a guide for a blade sharpening device to move along a cutting edge of a blade.

2. Description of the Prior Art

A variety of different devices are known for sharpening the blades of cutting implements. For example, sharpening stones and files are well known tools which are drawn across a cutting edge of a blade for sharpening. Other sharpening devices include grinding wheels which rotate and used by placing the edge of a cutting implement in engagement with the rotating wheel, and sharpeners typically used with knives or scissors wherein a body acts as a guide and whereby the cutting edge is drawn along a sharpening stone while generally held in a desired angular relationship by the guide.

However, some cutting blades are more robust and more difficult to sharpen. For example, the blades of rotary lawn mowers are designed to be larger and for heavy duty use. While these can be sharpened with conventional grinding wheels, these are often large and expensive machines not practical for use by those performing intermittent sharpening tasks. Moreover, typical grinding wheel sharpening apparatus do not appropriately support the blade and guide the relative movement of the sharpening apparatus along the blade. Thus, an improved blade sharpening apparatus, especially for larger blades such as those of rotary lawn mowers, is needed.

SUMMARY OF THE INVENTION

The blade sharpener of the present invention provides a mechanism which is not only designed for accurate blade sharpening, but is especially suited for use both by those which frequently sharpen blades as well as those whose sharpening activities are less frequent. The blade sharpener of the present invention not only provides adjustment in the sharpening angle, but provides excellent support for even large blades and further promotes proper sharpening techniques which enhance blade life.

Broadly speaking, the blade sharpener of the present invention includes a blade support including a receiving surface defining a blade axis, a sharpener guide mounted to said blade support, and a sharpener mount. The blade support is configured for supporting a blade to be sharpened on the blade receiving surface. The sharpener guide includes an elongated guide member defining a sharpening axis extending substantially parallel to the blade axis. The sharpener mount includes a pivot connector coupled to and complementally configured with the elongated guide member for enabling pivotal movement of the sharpener mount about the sharpening axis and also enables translational movement of the sharpener mount along the elongated guide member. In this way, a sharpening tool such as, for example, a grinder having a rotatable abrasive wheel, may be positioned to engage a cutting edge of a blade supported on the blade receiving surface and move along the cutting edge and engage the cutting edge to sharpen the blade at a desired cutting angle.

In preferred embodiments, the sharpener guide includes an adjuster which is pivotally mounted by a coupler to the blade support. The elongated guide may be mounted to the adjuster and by pivoting the adjuster about the coupler, which defines a pivot axis, the angle at which a sharpening tool mounted on the sharpener mount may be adjusted. The pivot axis which is parallel to the elongated guide member and also preferably parallel to the blade axis.

Furthermore, the coupler may be spaced from the elongated guide member, and the coupler may include a clamping member for retaining the adjuster in a selected, desired angular relationship to said blade support, which helps to keep the relative position of the sharpening tool even as the sharpener mount translates back and forth along the elongated guide member. This clamping member may include a bolt extending through aligned openings in the adjuster and blade support and a nut threadably received on the bolt, whereby the nut can be tightened to easily hold the adjuster at the desired angle relative to the blade support.

While the receiving surface can be variously configured to most readily accommodate different configurations of blades, the receiving surface may be substantially planar. This configuration of receiving surface may be advantageous for use in sharpening rotary lawn mower blades. The blade support may be configured to include a beam which extends substantially perpendicular to the blade-receiving surface, and the sharpener guide may be mounted to the beam. The beam may extend both above and below the sharpening surface. When so configured, the beam can be readily clamped between the jaws of a vise for holding the blade sharpening apparatus stable. Also, the blade support can be mounted directly to a table, bench or the like using clamps or alternatively threaded fasteners such as bolts or screws. When the beam extends downwardly relative to the supporting surface, it may be received in a slot in the table or bench, and this may further help to stabilize the blade sharpening apparatus. The beam may be configured to include a tongue which extends above the blade receiving surface and a blade-receiving gap can be provided between the tongue and the blade receiving surface so that elongated blades can be received on the blade receiving surface and the apparatus can be rugged and balanced. Also, a blade holding member can be provided and mounted to the beam or other part of the blade support. The blade holding member can be used to hold the blade on the blade-receiving surface and clamp the blade to fix it in position during sharpening. The blade holding member can include a bar which extends in a spaced, parallel plane to the blade-receiving surface and include one or a plurality of retaining members which are coupled to the bar for shiftable movement to hold and release the blade from the blade support.

The sharpener mount may include a bearing received on the elongated guide member for simultaneous pivotal movement about said elongated guide and translational movement along said guide. A sharpening tool may be mounted on the sharpener mount. The sharpener tool may be a file, abrasive stone, or more preferably, a grinder, such as a motorized grinder. The grinder may include a shaft carrying a rotatable abrasive wheel, the shaft being offset from said sharpening axis and having an axis of rotation which remains oriented substantially 90° relative to the sharpening axis during translation of the sharpener mount along the elongated guide member and during pivotal movement about the sharpening axis.

These and other features of the present invention will be appreciated by those skilled in the art with reference to the drawings and the detailed description of the preferred embodiment.

DESCRIPTION OF THE PREFERRED EMBODIMENT

Figure 1:
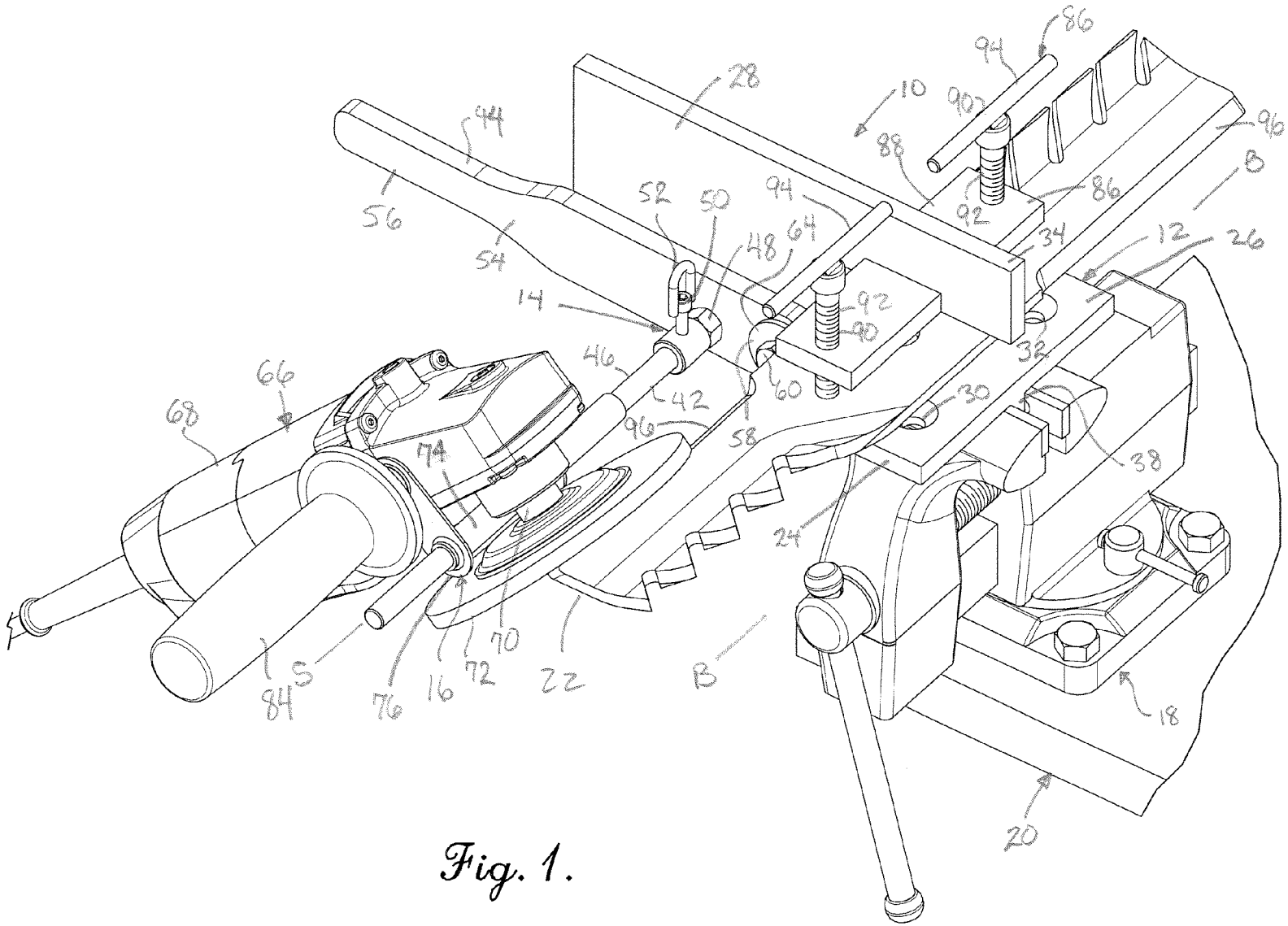
FIG. 1 is an upper front isometric view of a blade sharpener in accordance with the present invention, showing a rotary lawn mower blade located on the blade support, a sharpener guide pivotally coupled to the blade support, and a rotary grinder mounted to a sharpener mount.
Figure 2:
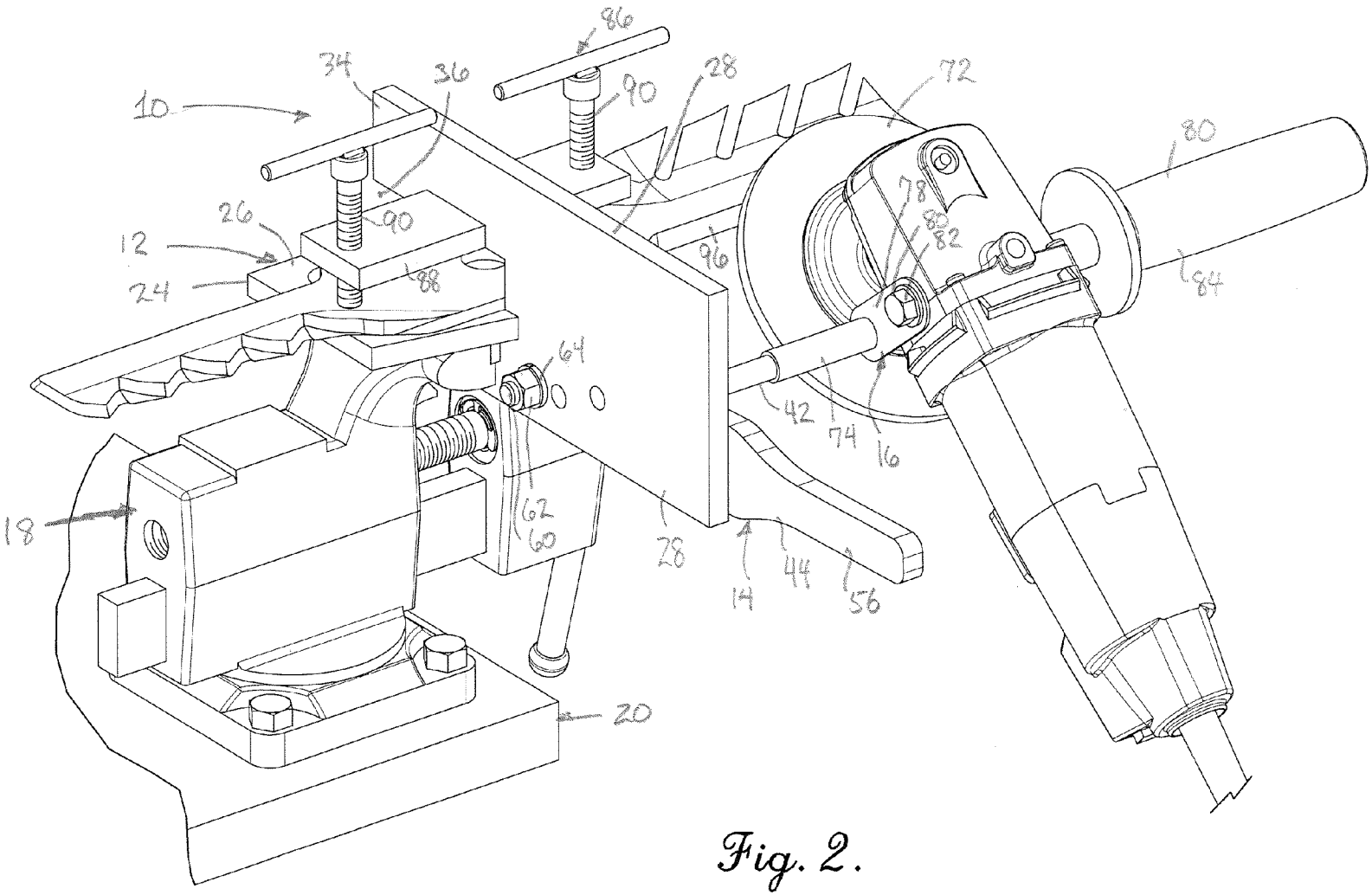
FIG. 2 is an upper rear front isometric view of the blade sharpener, showing the coupler as a bolt with a nut tightened thereon for holding the position of the sharpener guide relative to the blade support, and the blade sharpener clamped by a vise.
Figure 3:
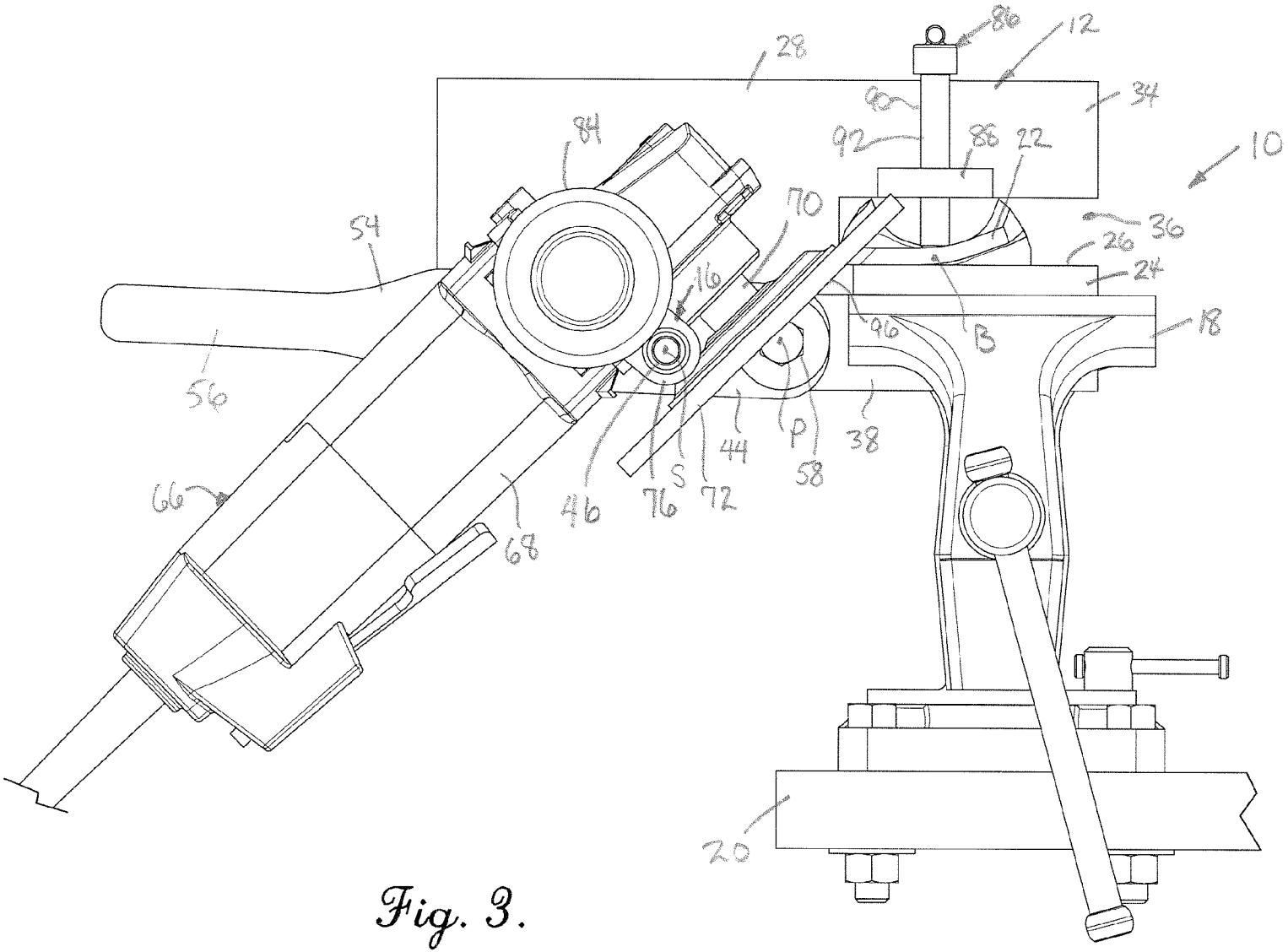
FIG. 3 is a left side elevational view of the blade sharpener, showing a grinding wheel of the grinder engaging a lawn mower blade for sharpening.
Figure 4:
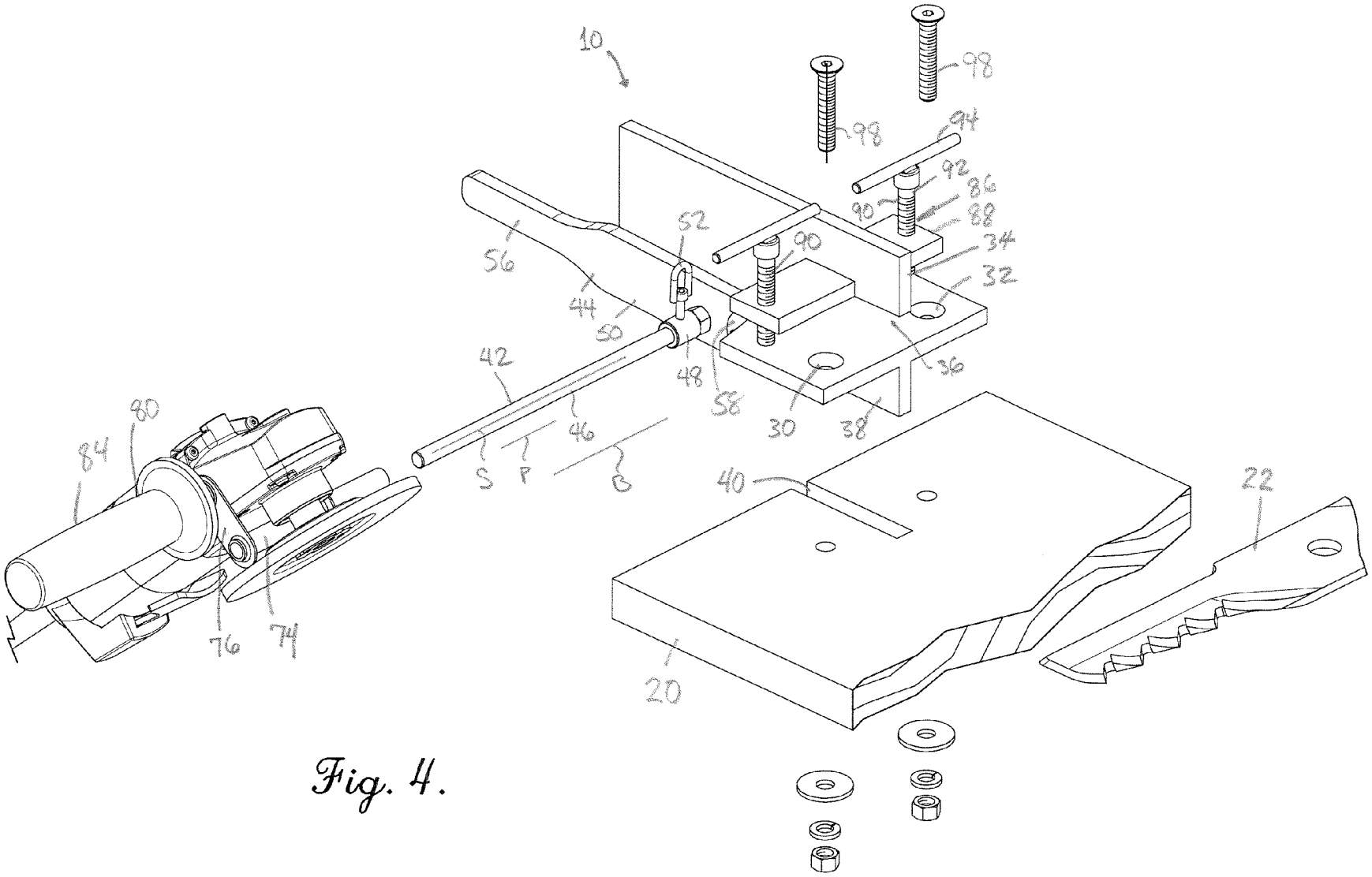
FIG. 4 is an exploded view showing the sharpener guide hereof positioned for mounting directly to a supporting surface having a slot therein.
Figure 5:
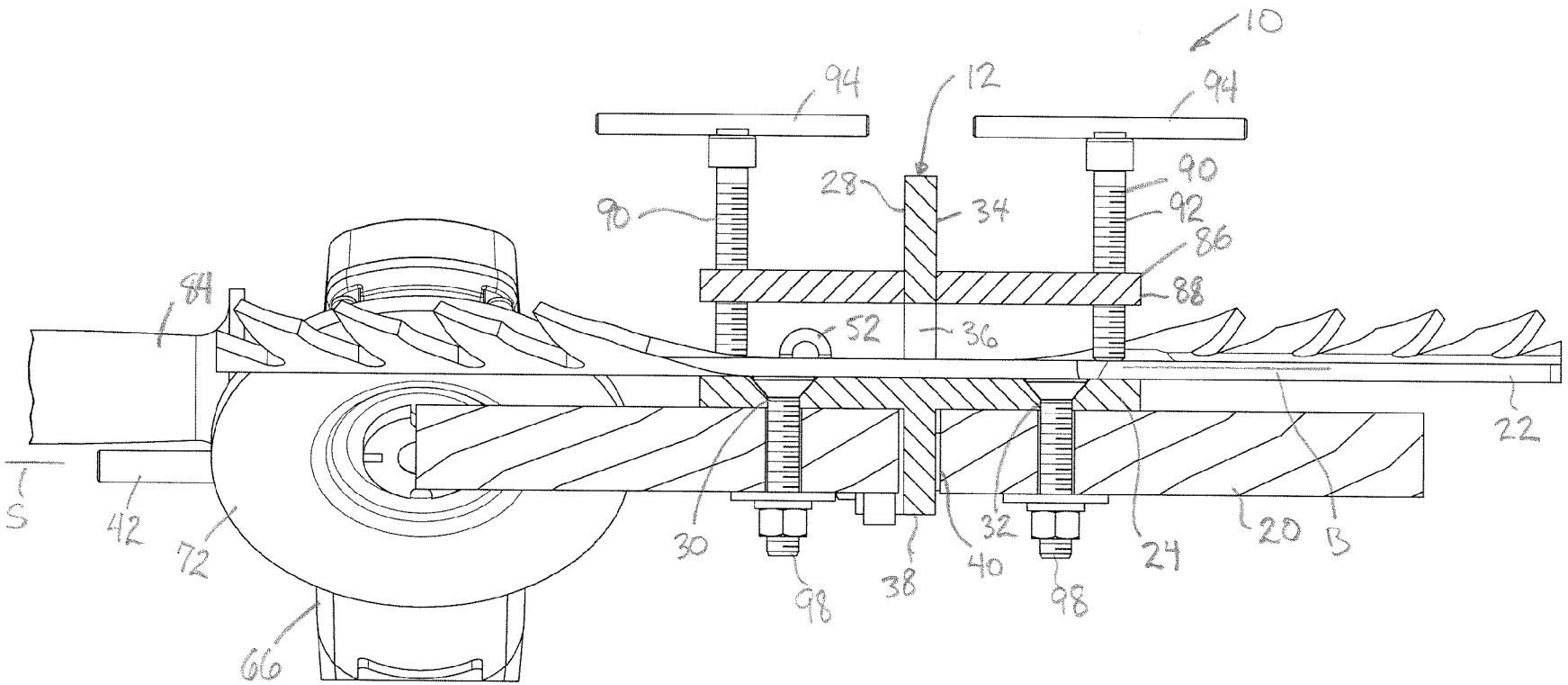
FIG. 5 is a front view of the blade sharpener hereof mounted to a supporting surface, with a portion of the blade support shown in vertical cross-section to illustrate the positioning of a lower part of a beam of the blade support received in a slot in the support surface.

Referring now to the drawings, an apparatus for use as a blade sharpener 10 broadly includes a blade support 12, a sharpener guide 14, and a sharpener mount 16. The blade sharpener 10 is configured to be held by a vise 18 coupled to a supporting surface 20 as shown in FIGS. 1-3, or alternatively mounted directly to the supporting surface 22 as shown in FIGS. 4 and 5. While the blade sharpener 10 is particularly adapted for sharpening the blade 22 of a rotary lawn mower, it may be appreciated that the blades of other tools having a cutting edge such as, for example, a machete, may also be sharpened by the blade sharpener 10 hereof.

In greater detail, the blade support 12 is preferably formed of metal such as mild steel and includes a base 24 including a blade receiving surface 26, and a beam 28. The base 24 may be drilled with holes 30 and 32 which may be countersunk. The blade receiving surface 26 is preferably elongated such that its width and depth as seen in FIG. 3 is smaller than its length as seen in FIG. 5. The blade receiving surface 26 presents a blade axis B which is generally parallel to the orientation of the elongated blade 22 positioned thereon in a sharpening position. While the blade receiving surface may be contoured, intermittent or otherwise configured, as shown in the drawings the blade receiving surface 26 is most preferably substantially flat and in normal use extends generally horizontally. The beam 28 is preferably positioned intermediate and most preferably substantially midway between the longitudinal ends of the base 24, and oriented substantially perpendicular to the blade receiving surface 26 as seen in FIG. 5. The beam 28 extends rearwardly from the base 24 and also includes a forwardly extending tongue 34. The tongue 34 is spaced upwardly from the blade receiving surface 26 to present a blade receiving gap 36 between the tongue and the receiving surface. The beam 28 also preferably includes a mounting or locating flange 38 which extends generally downwardly below the base 24 during normal orientation and use. While the flange 38 could be provided separate from the beam 28 and oriented generally parallel to blade axis B or at another angle, for economy of manufacture the flange 38 is most preferably generally aligned with the beam and perpendicular to the blade axis B. The flange 38 may then be conveniently clamped between the jaws of vise 18 as shown in FIGS. 1-3 or positioned in a slot 40 in the supporting surface 20 as shown in FIGS. 4 and 5.

The sharpener guide 14 includes an elongated guide member 42 and may, in particularly preferred embodiments, include an adjuster 44. The elongated guide member 42 may be configured as an elongated rod 46 of steel or the like defining a sharpener axis S. The rod 46 and the sharpener axis S is preferably substantially parallel to the blade axis B. The rod 46 may be mounted directly to the blade support 12, or more preferably to the adjuster 44 by a coupling 48. The rod 46 may be attached to the coupling 48 by set screw 50, and a guard 52 may be welded or otherwise attached to the adjuster 44. The adjuster 44 may be provided as an elongated element 54 having a rearwardly extending handle 56 and pivotally mounted to the blade support 12 by a coupler 58. The coupler 58 defines a pivot axis P which is generally parallel to the sharpener axis S and spaced generally rearwardly therefrom as shown in FIG. 3. The coupler 58 as illustrated includes a bolt 60 which extends through aligned holes in the adjuster 44 and the beam 28 of the blade support 12, a nut 62 which is threaded onto the bolt 58 which provides a clamping force to tighten the adjuster 44 against the beam 28 (or loosening to permit pivoting of the sharpener guide 14) and associated washers 64.

The sharpener mount 16 is configured to support a sharpening tool 66. The particular configuration of the sharpener mount 16 will thus vary according to the particular sharpening tool 66, for example a sharpening stone, file, or, as illustrated in the drawings, a rotary, motor-driven grinder 68 having a shaft 70 rotatably mounting an abrasive wheel 72 thereon. The sharpener mount 16 is configured for translation back and forth along the elongated guide member 42 and preferably pivoting thereon. In this regard, when the elongated guide member 42 is configured as rod 48, the sharpener mount 16 may be provided with a bearing 74 which is complementally configured with the rod 48 to retain the sharpener mount 16, and therefor the sharpening tool 66, in alignment and to shift along the rod 48 as well as pivot about it. The bearing 74 thus permits translational movement of the sharpener mount 16 toward and away from the blade support 12 and pivoting movement about axis S. The sharpener mount 16 may be provided with a pair of arms 76 and 78, with the bearing 74 coupled proximate one end of the arms, and attachments 80 extending through holes proximate the other end of the arms 76 and 78. As shown in FIGS. 1 and 2, for example, these attachments 80 serve to mount the sharpening tool 66 to the arms 76 and 78, preferably fixedly so as to prevent pivoting of the sharpening tool 66 relative to the sharpener mount 16. When the sharpening tool 16 is a grinder 68 as illustrated, the attachments 80 are relatively simple, such as a bolt 82 and the grinder handle 84, because the grinder 68 is provided with threaded holes which threadably receive the bolt 82 and the grinder handle 84. Thus, simply by inserting the bolt 82 and grinder handle 84 into the threaded holes in the grinder 68 and tightening, the sharpening tool is fixably coupled to the sharpener mount 16.

A blade holding member 86 is also preferably provided, and this may be provided as a part of the blade support 12 as shown in FIGS. 1 through 5. The blade holding member 86 may include a bar 88 positioned above the blade receiving surface 26 and coupled to the beam 28. The bar 88 may be provided with one or a pair of securement members 90, which may be threaded rods 92 provided with handles 94 for holding the blade 22 in fixed position against the blade receiving surface 26 with the blade extending generally through the gap 36 and oriented to have its cutting edge 96 extend along or generally parallel to the blade axis B.

The blade sharpening apparatus 10 of the present invention greatly simplifies the task of sharpening large, rugged blades of cutting tools. The provision of the flange 38 permits the blade support 12 to be held by a vise 18. By simply inserting the mounting flange 38 between the jaws of the vise 18 and tightening the jaws against the mounting flange 38, the blade support 12 is held in position ready to receive a blade 22 of a cutting tool. Alternatively, as shown in FIGS. 4 and 5, the blade sharpening apparatus 10 can be mounted directly to a supporting surface 20 such as a table or bench top. The mounting flange 38 need not be included for mounting directly to a supporting surface 20, as threaded fasteners 98 such as bolts and nuts, lag screws or the like can be inserted through the holes 30 and 32 in the base 24 and held by nuts or threading into the material of the supporting surface 20. However, when the flange 38 is a part of the blade support 12, the provision of slot 40 in the supporting surface 20 gives additional lateral support and removes some of the stress on the threaded fasteners 86.

After the sharpening tool 66 is mounted to the sharpener mount 16 as shown in the drawings and described above, the sharpener mount 16 is coupled to the sharpener guide 14 by sliding the bearing 74 over the rod 48. The coupler 58 may be loosened to permit pivoting of the adjuster 44 to the desired position. Because the sharpening tool 66 may be free to pivot about the rod 48, the pivoting of the adjuster 44 largely provides for comfort and a natural position for the sharpening tool 66 as shown in FIG. 3, so that the sharpening tool 66 assumes an orientation consistent with the existing angle to which the blade 22 was previously sharpened. However, in some applications it may be desired to have the angle between the sharpening tool and the orientation of the blade (i.e., the sharpening angle) controlled to a greater degree. If this is desired, then the rod 48 could be, for example, a square rod and the bearing 78 could be provided with a complementally sized and configured inner configuration so that the bearing 78 could translate along the rod 48 but not pivot. In this way, the user would pivot and then tighten the adjuster to determine the desired sharpening angle. The blade 22 is then placed atop the blade receiving surface 26 with the cutting edge 96 oriented toward the sharpening tool 66. The blade 22 is positioned in the gap 36 between the tongue 34 and the blade receiving surface 26. Then, the threaded rods 92 of the blade holding member are rotated to hold the blade 22 in position. In operation, it is believed that improved sharpening without unintentional rounding of the cutting edge 96 of the blade 22 can be accomplished by starting the grinder 68 so that the shaft 70 and the abrasive wheel 72 rotate, and then moving the grinder 68 in a generally inward direction toward the beam. In this way, there is a lesser tendency to have the abrasive wheel excessively grind the tip of the cutting edge 96, thereby causing rounding. Typical rotary mower blades 22 have two cutting edges, and in this way once one cutting edge 96 is sufficiently sharpened, the blade 22 is released from the blade receiving surface 26, rotated 180°, and then the other cutting edge 96 of the blade 22 can be sharpened.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. Apparatus for use in sharpening elongated cutting edges of blades of cutting tools, said apparatus comprising:

a blade support adapted to support a cutting tool having a blade including an elongated cutting edge, said blade support including a receiving surface defining a blade axis arranged parallel to the cutting edge of the cutting tool mounted thereon and a beam extending substantially perpendicular to said receiving surface;

a sharpener guide mounted to said blade support, said sharpener guide including an elongated guide member defining a sharpening axis extending substantially parallel to said blade axis; and a sharpener mount including a pivot connector coupled to and complementally configured with said elongated guide member for enabling linear movement of said sharpener mount along said elongated guide member and thus along said sharpening axis parallel to said blade axis and simultaneous pivotal movement of said sharpener mount about said sharpening axis, wherein said sharpener guide is mounted to said beam, said beam including a tongue spaced from said receiving surface for defining a blade-receiving gap between said tongue and said receiving surface.

2. Apparatus for use in sharpening blades as set forth in claim 1, wherein said sharpener guide includes an adjuster, said elongated guide member being mounted to said adjuster, said apparatus further including a coupler pivotally connecting the adjuster to the blade support for pivotal movement about a pivot axis oriented substantially parallel to said sharpening axis.

3. Apparatus for use in sharpening blades as set forth in claim 2, wherein said coupler is spaced from said elongated guide member and said coupler includes a clamping member for retaining said adjuster in a selected angular relationship to said blade support.

4. Apparatus for use in sharpening blades as set forth in claim 3, wherein said clamping member includes a bolt and a nut threadably mounted on said bolt.

5. Apparatus for use in sharpening blades as set forth in claim 1, wherein said receiving surface is substantially planar.

6. Apparatus as set forth in claim 1, further including a blade holding member.

7. Apparatus as set forth in claim 6, wherein said blade holding member includes a bar extending substantially parallel to and spaced from said receiving surface and at least one retaining member coupled to said bar for shiftable movement toward and away from said receiving surface.

8. Apparatus as set forth in claim 1, wherein said sharpener mount includes a bearing received on said elongated guide member for simultaneous pivotal movement about said elongated guide member and translational movement along said elongated guide member.

9. Apparatus as set forth in claim 1, further including a sharpening tool mounted to said sharpener mount.

10. Apparatus as set forth in claim 9, wherein said sharpening tool includes a grinder coupled to said sharpener mount, said grinder including a shaft carrying a rotatable abrasive wheel, said shaft being offset from said sharpening axis and having an axis of rotation which remains oriented substantially 90° relative to said sharpening axis during translation of said sharpener mount along said elongated guide member and pivotal movement about said sharpening axis.

11. Apparatus as set forth in claim 1, wherein said blade support includes a flange extending downwardly from said receiving surface when said receiving surface is oriented generally horizontally.

12. Apparatus as set forth in claim 1, wherein said blade support includes a plurality of holes extending through said receiving surface.

* * * * *